US009773604B2

(12) United States Patent
Kim et al.

(10) Patent No.: US 9,773,604 B2
(45) Date of Patent: Sep. 26, 2017

(54) POWER INDUCTOR AND METHOD OF MANUFACTURING THE SAME

(71) Applicant: SAMSUNG ELECTRO-MECHANICS CO., LTD., Suwon-Si, Gyeonggi-Do (KR)

(72) Inventors: Min Young Kim, Suwon-Si (KR); Jin Mo Ahn, Suwon-Si (KR); Jae Yeol Choi, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/946,629

(22) Filed: Nov. 19, 2015

(65) Prior Publication Data

US 2016/0181002 A1 Jun. 23, 2016

(30) Foreign Application Priority Data

Dec. 23, 2014 (KR) ..... 10-2014-0186940

(51) Int. Cl.

| | |
|---|---|
| ***H01F 27/24*** | (2006.01) |
| ***H01F 5/00*** | (2006.01) |
| ***H01F 27/255*** | (2006.01) |
| ***H01F 17/00*** | (2006.01) |
| ***H01F 17/04*** | (2006.01) |
| ***H01F 27/29*** | (2006.01) |
| ***H01F 41/04*** | (2006.01) |

(52) U.S. Cl.

CPC ..... *H01F 27/255* (2013.01); *H01F 17/0013* (2013.01); *H01F 17/04* (2013.01); *H01F 27/292* (2013.01); *H01F 41/046* (2013.01)

(58) Field of Classification Search

CPC .... H01F 27/255; H01F 27/2804; H01F 27/29; H01F 27/245; H01F 27/292; H01F 41/041; H01F 41/0233; H01F 41/046; H01F 2027/2809; H01F 17/0013; H01F 17/04

USPC ..... 336/200, 233, 232; 29/605

See application file for complete search history.

(56) References Cited

U.S. PATENT DOCUMENTS

2013/0113593 A1* 5/2013 Jeong ..... H01F 17/0013 336/200
2013/0154786 A1* 6/2013 Nakajima ..... H01F 5/003 336/200
2013/0293334 A1* 11/2013 Shin ..... H01F 1/26 336/192

FOREIGN PATENT DOCUMENTS

JP 2013-055232 A 3/2013
KR 10-2013-0049875 A 5/2013

* cited by examiner

*Primary Examiner* — Mangtin Lian
(74) *Attorney, Agent, or Firm* — McDermott Will & Emery LLP

(57) ABSTRACT

A power inductor includes: a substrate on which an internal electrode coil pattern is formed; and composite layers formed by alternately stacking first sheets formed of a mixture of coarse metal powder and fine metal powder and second sheets formed of fine metal powder on the internal electrode coil pattern of the substrate, thereby obtaining high inductance.

13 Claims, 3 Drawing Sheets

POWER INDUCTOR AND METHOD OF MANUFACTURING THE SAME

CROSS-REFERENCE TO RELATED APPLICATION

This application claims benefit of priority to Korean Patent Application No. 10-2014-0186940 filed on Dec. 23, 2014, with the Korean Intellectual Property Office, the disclosure of which is incorporated herein by reference.

TECHNICAL FIELD

The present disclosure relates to a power inductor having an improved packing factor, and a method of manufacturing the same.

BACKGROUND

In accordance with the miniaturization of electronic devices, electronic components used in the electronic devices have been miniaturized and made light in weight. However, a relative ratio of a volume of a power supply circuit used in the electronic device to an entire volume of the electronic device tends to be increased.

The speed and degrees of integration of various large scale integrated circuits (LSI) including a central processing unit (CPU) used in various electronic circuits have increased, but it is difficult to miniaturize magnetic components such as an inductor and a transformer, which are essential elements of the power supply circuit.

When a volume of a magnetic body is decreased due to the miniaturization of the magnetic components such as the inductor and the transformer, a magnetic core may be easily magnetically saturated, and thus an amount of current used as power is decreased.

Examples of magnetic materials used for manufacturing the inductor include a ferrite based material and a magnetic metal material. Here, the ferrite based material is mainly used in a multilayer inductor which is advantageous in mass production and miniaturization.

Ferrite has high magnetic permeability and electrical resistance, but also has a low saturated magnetic flux density, and thus, when ferrite is used, inductance is significantly decreased due to magnetic saturation, and direct current (DC) bias characteristics are deteriorated.

In addition, in a case of a multilayer power inductor, a ferrite body is sintered together with electrodes at a high temperature, and is manufactured by stacking, compressing, and hardening several sheets formed of metal powder. However, in a case of the stacking scheme described above, there is a limitation in improving a packing factor, and thus it may be difficult to manufacture a power inductor having high inductance.

SUMMARY

An aspect of the present disclosure may provide a power inductor capable of obtaining higher inductance, as compared with an existing power inductor having the same size, by including composite layers formed by alternately stacking sheets formed of fine metal powder and sheets formed of a mixture of fine metal powder and coarse metal powder on a substrate on which internal electrode coil patterns are formed.

According to an aspect of the present disclosure, a power inductor may include: a substrate on which an internal electrode coil pattern is formed; and composite layers formed by alternately stacking first sheets formed of a mixture of fine metal powder and coarse metal powder and second sheets formed of fine metal powder on the internal electrode coil pattern of the substrate, and thus a metal packing factor may be improved, whereby inductance of the power inductor may be improved.

The second sheets may be formed of a metal powder slurry having a particle diameter of 2.5 μm or less, and the second sheets may have a thickness of 10 μm or less. The first sheets may be formed of a mixture of coarse metal powder having a particle diameter of 10 μm or more and fine metal powder having a particle diameter of 2.5 μm or less.

According to another aspect of the present disclosure, a method of manufacturing a power inductor may include: preparing a substrate on which an internal electrode coil pattern is formed; forming composite layers on the internal electrode coil pattern of the substrate, the composite layers being formed by alternately stacking first sheets formed of a mixture of fine metal powder and coarse metal powder and second sheets formed of fine metal powder; and forming external electrodes.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
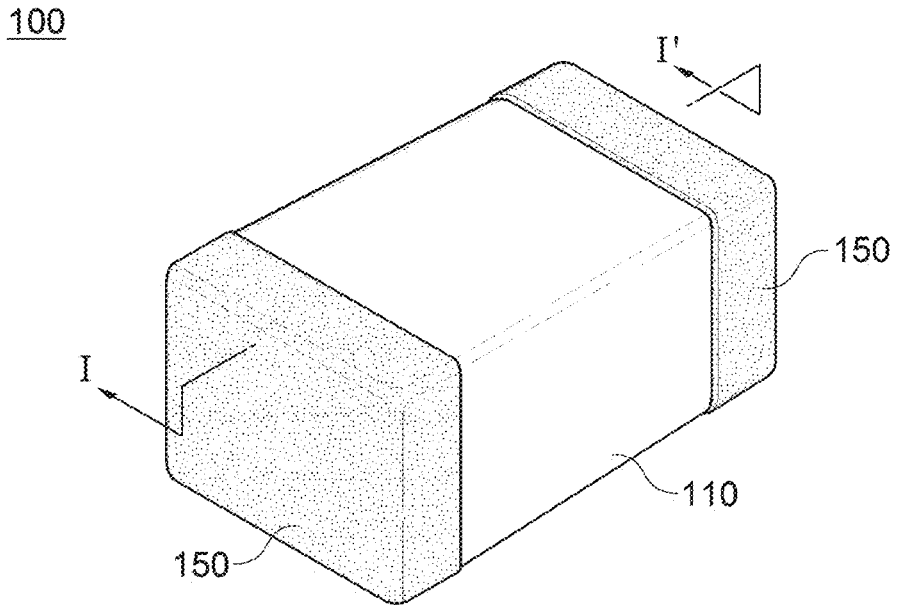
FIG. 1 is a perspective view of a power inductor, according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
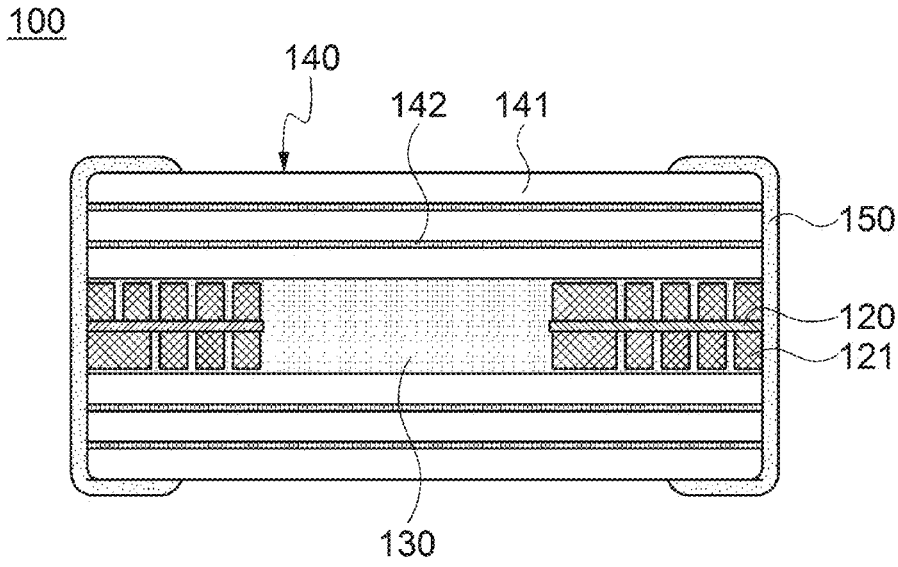
FIG. 2 is a cross-sectional view taken along line I-I' of FIG. 1.

FIG. 1 is a perspective view of a power inductor, according to an exemplary embodiment, and FIG. 2 is a cross-sectional view taken along line I-I' of FIG. 1.

As illustrated in FIGS. 1 and 2, a power inductor 100 according to an exemplary embodiment may include a substrate 120 on which internal electrode coil patterns 121 are formed, composite layers 140 formed on the internal electrode coil patterns 121 on the substrate 120, and external electrodes 150 formed on both end surfaces of an inductor body 110 in which the substrate 120 and the composite layers 140 are stacked.

The substrate 120 may be formed of an insulating material such as a photosensitive polymer, a magnetic material such as ferrite, or the like, and may be a support base of the internal electrode coil patterns 121 and the composite layers 140.

The internal electrode coil patterns 121 may be formed on both surfaces of the substrate 120, and include a plurality of coil pattern portions provided on the same plane, and thus a spiral inductor coil may be formed. In addition, an insulating material may be formed between the internal electrode coil patterns 121 to prevent short circuits between the coil pattern portions. One end of an internal electrode coil pattern 121 formed on the substrate 120 may be electrically connected to one end of another internal electrode coil pattern 121 formed below the substrate 120 through a via (not illustrated).

The internal electrode coil patterns 121 may be formed by a thick film formation method through printing, applying, depositing, sputtering, or the like. In addition, the internal electrode coil patterns 121 may be formed of one or more selected from the group consisting of silver (Ag), tin (Sn), nickel (Ni), platinum (Pt), gold (Au), copper (Cu), and alloys thereof, which are various known materials able to perform the same function.

The composite layers 140 may be stacked to enclose upper and lower surfaces of the substrate 120 to form cover parts. In addition, the composite layers 140 may circulate a magnetic flux generated from the inductor coil embedded therein through a predetermined path to prevent deteriorations in electrical characteristics of the inductor.

The composite layers 140 may be formed by mixing metal powder with a polymer resin and a binder, and may include first and second sheets 141 and 142 which are alternately stacked. Here, the first sheets 141 may be sheets in which the metal powder is dispersed in the polymer resin, and the second sheets 142 may be sheets having the form of slurry in which the metal powder is aggregated.

In detail, the first sheets 141 may have a form in which fine metal powder and coarse metal powder are dispersed in the polymer resin or a form in which aggregates of fine metal powder and coarse metal powder are dispersed. Therefore, since the polymer resin of the first sheets 141 maintains insulating properties and the metal powder dispersed in the polymer resin is provided in the first sheets 141, the first sheets 141 may improve inductance characteristics and reliability of the power inductor.

The first sheets 141 may be sheets in which the coarse metal powder (having a particle diameter of 10 μm or more) and the fine metal powder (having a particle diameter of 2.5 μm or less) are mixed with the resin and the binder, and may be formed to have a thickness of 70 μm or more in order to maintain dispersibility and sheet uniformity.

Here, the metal powder may be formed of a material selected from the group consisting of iron-nickel (Fe—Ni), iron-nickel-silicon (Fe—Ni—Si), iron-aluminum-silicon (Fe—Al—Si), and iron-aluminum-chrome (Fe—Al—Cr), but is not limited thereto.

The metal powder may be of a magnetic material for maintaining a high packing factor when a size of the power inductor is decreased. The first sheets 141 formed of the metal powder may increase magnetic permeability of the power inductor.

The polymer resin, which provides insulating properties, may be formed of any one selected from the group consisting of an epoxy resin, a phenol resin, a urethane resin, a silicon resin, a polyimide resin, and the like, or a mixture thereof. Here, since the first sheet 141 has the insulating properties, the first sheet 141 may be provided as the outermost layer of the composite layers 140.

The second sheets 142 may be sheets in which the metal powder is formed in the form of slurry. Since the second sheets 142 are interposed between the first sheets 141 and the first and second sheets 141 and 142 are stacked, pressed and heated to thereby be closely adhered to each other, thereby improving a packing factor of the metal powder in the composite layers 140, the second sheets 142 may be useful for manufacturing a power inductor having high inductance.

Since any metal powder contained in the second sheets 142 is only fine metal powder (having a particle diameter of 2.5 μm or less) and the second sheets 142 are manufactured in the form of slurry including the fine metal powder, the second sheets 142 may be positioned between the first sheets 141 in order to significantly decrease an influence of external force, and thus deformation of the second sheets 142 may be prevented. In addition, the second sheets 142 may be formed to have a thickness of 10 μm or less in order to prevent magnetic flux saturation generated due to an excessive increase in metal density.

As a result, in a power inductor including composite layers including only the first sheets 141 in which the metal powder is dispersed in the polymer resin, it may be difficult to disperse the metal powder in a predetermined ratio or more, and thus rigidity of the power inductor may be weak.

Therefore, due to the composite layers 140 formed by interposing the second sheets 142 formed of the fine metal powder as the only metal powder between the first sheets 141 formed of the coarse metal powder and the fine metal powder, a power inductor having high inductance may be manufactured.

Meanwhile, a cavity corresponding to a space into which a magnetic core 130 is inserted may be formed in a central portion of the substrate 120. The magnetic core 130, a core having an inductor coil wound therearound, may have a shape corresponding to that of the cavity.

The magnetic core 130 may be formed of metal powder such as ferrite, or the like, and may be formed by dispersing the metal powder containing at least one of iron (Fe), a nickel-iron alloy (Ni—Fe), sendust (Fe—Si—Al), and an iron-silicon-chrome alloy (Fe—Si—Cr) in a polymer resin.

Since the magnetic core 130 has a volume smaller than those of the upper and lower composite layers, the magnetic core 130 may be formed of a magnetic material containing the metal powder in order to increase a packing factor. Here, a particle diameter of any metal powder contained in the magnetic core may be 2.5 μm or less.

In a case in which the particle diameter of the metal powder exceeds 2.5 μm, large powder particles may be precipitated when metal powder slurry is prepared, resulting in problematic dispersion. That is, when the metal powder is dispersed, the metal powder having a large particle diameter may be precipitated in the slurry, and thus it may not be uniformly dispersed.

In addition, magnetic permeability and a quality (Q) value of the magnetic core 130 needs to be increased to promote loss stabilization. Here, the magnetic core 130 may be manufactured by compression-molding metal powder having high magnetic permeability to maintain magnetic properties at a high current density and decrease core loss as much as possible. That is, since the magnetic core 130 is formed of the metal powder to thereby be manufactured to have a density higher than that of the upper and lower composite layers 140, the magnetic core 130 may have high magnetic permeability. Since the magnetic core 130 is inserted into the cavity of the substrate and is sealed by the composite layer 140, a structure of the magnetic core 130 is not required to be a structure in which two sheets are alternately formed as in the composite layers 140.

The magnetic core 130 may have a shape corresponding to that of the cavity of the substrate 120, and a cross-sectional shape thereof may be quadrangular, oval, circular, polygonal, or the like, and a size thereof may be as large as possible.

Figure 3:
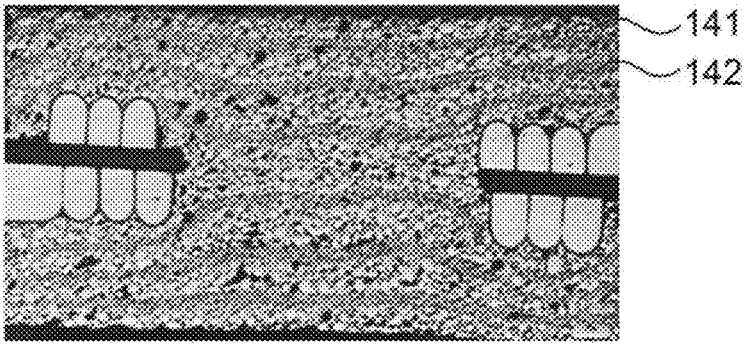
FIG. 3 is a cross-sectional view of a photograph of a power inductor captured by a scanning electron microscope (SEM), according to an exemplary embodiment in the present disclosure.
Figure 4:
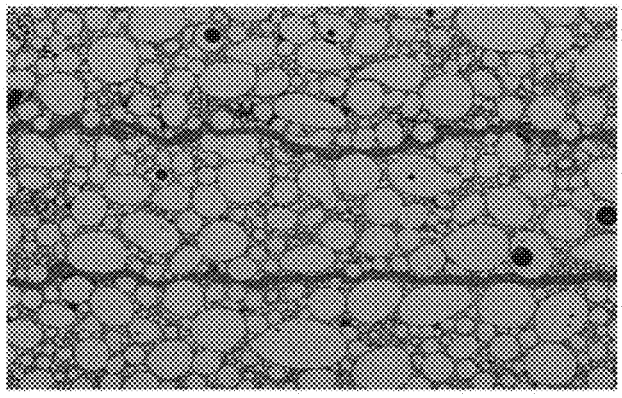
FIG. 4 is an enlarged cross-sectional view of a composite layer in the photograph of FIG. 3 captured by the SEM.

FIG. 3 is a cross-sectional view of a photograph of a power inductor captured by a scanning electron microscope (SEM), according to an exemplary embodiment, and FIG. 4 is an enlarged cross-sectional view of a composite layer in the photograph of FIG. 3 captured by the SEM.

As illustrated in FIGS. 3 and 4, the first sheets 141 may be sheets in which coarse metal powder and fine metal powder are mixed with each other. In detail, the first sheets 141 may be sheets in which fine metal powder having a particle diameter of 2.5 μm or less and coarse metal powder having a particle diameter of 10 μm or more are mixed with a resin and a binder, and may be formed to have a thickness of 70 μm or more.

The second sheets 142, sheets formed of fine metal powder having a particle diameter of 2.5 μm or less as the only metal powder, may have a thin band shape, and may have a thickness of 10 μm or less. In addition, since the fine metal powder of the second sheets 142 on boundaries between the first and second sheets 141 and 142 permeates into the first sheets 141 when the inductor body is fired, the second sheets 142 may be useful in manufacturing the power inductor having high inductance.

Figure 5:
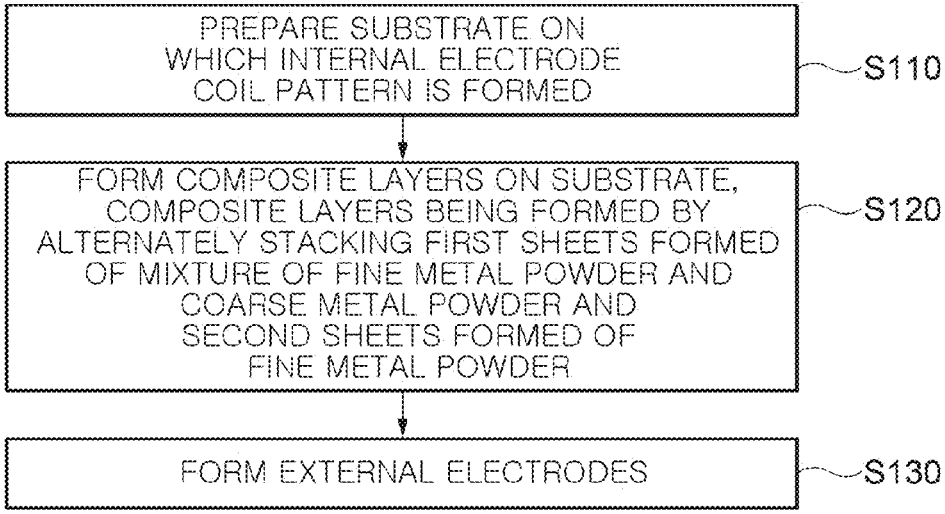
FIG. 5 is a flowchart illustrating a method of manufacturing a power inductor, according to an exemplary embodiment in the present disclosure.

Next, a method of manufacturing a power inductor according to an exemplary embodiment will be described. FIG. 5 is a flowchart illustrating a method of manufacturing a power inductor according to an exemplary embodiment.

As illustrated in FIG. 5, the method of manufacturing a power inductor according to an exemplary embodiment may include preparing the substrate 120 on which the internal electrode coil patterns 121 are formed (S110), stacking the composite layers 140 on the internal electrode coil patterns 121 of the substrate 120 (S120), and forming the external electrodes 150 (S130). The composite layers 140 may be formed by alternately stacking the second sheets 142 formed of the fine metal powder and the first sheets 141 formed of the mixtures of the fine metal powder and the coarse metal powder.

First, in the preparing of the substrate 120 on which the internal electrode coil patterns 121 are formed, the internal electrode coil patterns 121 may be printed on both surfaces of the substrate 120 to form a coil serving as an inductor. A via (not illustrated) penetrating through the substrate may be formed to electrically connect the internal electrode coil patterns 121 formed on one surface and the other surface of the substrate 120 to each other.

The via (not illustrated) may be formed by forming a through-hole in a thickness direction of the substrate using laser drilling, computer numerical control (CNC) drilling, or the like, and filling the through-hole with a conductive paste. Here, the conductive paste and the internal electrode coil patterns may be formed of the same metal in consideration of process efficiency and electrical conduction efficiency.

Here, the via and the internal electrode coil patterns may be formed of at least one selected from the group consisting of silver (Ag), tin (Sn), nickel (Ni), platinum (Pt), gold (Au), copper (Cu), and alloys thereof, or a combination thereof, which are various known materials able to perform the same function.

An insulating material (not illustrated) enclosing circumferential surfaces of the internal electrode coil patterns 121 and having insulating properties may be applied onto the internal electrode coil patterns 121 to prevent short circuits between the internal electrode coil patterns.

Next, the cavity penetrating through a central portion of the substrate 120 may be formed. The cavity corresponding to the space into which the magnetic core 130 of the inductor is inserted may be a region in which the internal electrode coil patterns 121 are not formed. The cavity may be formed by using the same method as a method of forming the via. In addition, the magnetic core 130 may be inserted into the cavity to form a path through which a magnetic flux of the inductor passes.

Next, the composite layers 140, in which the first sheets 141 formed by dispersing the fine metal powder and the coarse metal powder in the polymer resin and the second sheets 142 formed of the fine metal powder are alternately stacked, may be stacked on the substrate 120 and the magnetic core 130. Since the first sheet 141 is formed by dispersing the metal powder in the polymer resin to have insulating properties, the first sheet 141 may be provided as the outermost layer of the composite layers 140.

In addition, the second sheets 142 may be formed of the metal powder in the form of slurry, and may be interposed between the first sheets to improve a packing factor.

The composite layer 140 may be formed by alternately stacking the first and second sheets 141 and 142 on the substrate and then pressing, heating, and compressing the first and second sheets 141 and 142. In this case, some of the metal powder of the second sheets 142 on boundaries between the first and second sheets 141 and 142 may permeate into the first sheets 141, and thus a metal packing factor of the composite layer 140 may be improved.

Next, the external electrodes 150 may be formed on the end surfaces of the inductor body formed as described above. The external electrodes 150 may be electrically connected to the ends of the internal electrode coil patterns 121 exposed to both end surfaces of the inductor body.

The external electrodes 150 may be formed by plating, paste printing, or the like, and may be formed of at least one selected from the group consisting of silver (Ag), tin (Sn), nickel (Ni), platinum (Pt), gold (Au), copper (Cu) having electrical conductivity, and alloys thereof, which are various known materials able to perform the same function.

As set forth above, in the power inductor according to an exemplary embodiment, the cover layers may be formed of the composite layers in which the first sheets formed by dispersing the coarse metal powder and the fine metal powder in the polymer resin and the second sheets formed of the fine metal powder are alternately stacked, and thus the metal powder packing factor of the cover layers is improved, whereby high magnetic permeability and high inductance of the power inductor may be secured.

While exemplary embodiments have been shown and described above, it will be apparent to those skilled in the art that modifications and variations could be made without departing from the scope of the present invention as defined by the appended claims.

What is claimed is:

1. A power inductor comprising:

a substrate;

an internal electrode coil pattern provided on the substrate;

first sheets disposed on the internal electrode coil pattern and formed of a mixture of fine metal powder having a particle diameter equal to or less than a first predetermined diameter and coarse metal powder having a second particle diameter equal to or greater than a second predetermined diameter greater than the first predetermined diameter; and second sheets disposed on the first sheets, formed of fine metal powder having a particle diameter equal to or less than the first predetermined diameter, and containing no coarse metal powder having a particle diameter equal to or greater than the second predetermined diameter wherein the first and second sheets are alternately stacked to form composite layers.

2. The power inductor of claim 1, wherein the first sheet is provided as an outermost layer of the composite layers.

3. The power inductor of claim 1, wherein the second sheet is formed of metal powder slurry having a particle diameter of 2.5 μm or less.

4. The power inductor of claim 1, wherein the second sheet has a thickness of 10 μm or less.

5. The power inductor of claim 1, wherein the first predetermined diameter is 2.5 μm and the second predetermined diameter is 10 μm.

6. The power inductor of claim 1, further comprising a magnetic core inserted into a cavity formed in a central portion of the substrate.

7. The power inductor of claim 6, wherein fine metal powder having a particle diameter of 2.5 μm or less is dispersed in a polymer resin to form the magnetic core.

8. A method of manufacturing a power inductor, the method comprising:

preparing a substrate on which an internal electrode coil pattern is formed;

forming composite layers on the internal electrode coil pattern of the substrate, the composite layers being formed by alternately stacking first sheets and second sheets; and forming external electrodes, wherein the first sheets are formed of a mixture of fine metal powder having a particle diameter equal to or less than a first predetermined diameter and coarse metal powder having a second particle diameter equal to or greater than a second predetermined diameter greater than the first predetermined diameter, and the second sheets are formed of fine metal powder having a particle diameter equal to or less than the first predetermined diameter and contain no coarse metal powder having a particle diameter equal to or greater than the second predetermined diameter.

9. The method of claim 8, wherein in the preparing of the substrate, a cavity is formed in a central portion of the substrate and a magnetic core is inserted into the cavity.

10. The method of claim 8, wherein an outermost layer of the composite layers is formed of the first sheet.

11. The method of claim 8, wherein the second sheet is formed by aggregating fine metal powder having a particle diameter of 2.5 μm or less.

12. The method of claim 8, wherein the second sheet has a thickness of 10 μm or less.

13. The method of claim 8, wherein the first predetermined diameter is 2.5 μm and the second predetermined diameter is 10 μm.

* * * * *